US005862442A

United States Patent [19]

Ahn

[11] Patent Number: 5,862,442

[45] Date of Patent: Jan. 19, 1999

[54] METHOD FOR DRIVING AGITATOR

[75] Inventor: Hyung-Sun Ahn, Suwon, Rep. of Korea

[73] Assignee: SamSung Electronics Co., Ltd., Kyungki-do, Rep. of Korea

[21] Appl. No.: 917,064

[22] Filed: Aug. 25, 1997

[30] Foreign Application Priority Data

Aug. 24, 1996 [KR] Rep. of Korea ..... 1996-35458

[51] Int. Cl.[6] ..... G03G 15/08; G03G 15/00

[52] U.S. Cl. ..... 399/127; 399/254

[58] Field of Search ..... 399/77, 127, 254, 399/255, 256, 258, 262, 263

[56] References Cited

U.S. PATENT DOCUMENTS

| | | | |
|---|---|---|---|
| 4,739,367 | 4/1988 | Watanabe et al. | 399/111 |
| 4,977,428 | 12/1990 | Sakakura et al. . | |
| 5,055,881 | 10/1991 | Fukuchi . | |
| 5,124,752 | 6/1992 | Kanno et al. . | |
| 5,134,444 | 7/1992 | Tabuchi et al. . | |
| 5,177,546 | 1/1993 | Tsubo . | |
| 5,317,370 | 5/1994 | Kohyama et al. . | |
| 5,353,102 | 10/1994 | Sato et al. . | |
| 5,523,832 | 6/1996 | Hamamichi et al. . | |

FOREIGN PATENT DOCUMENTS

| | | |
|---|---|---|
| 54-116241 | 9/1979 | Japan . |
| 58-214174 | 12/1983 | Japan . |
| 1-291273 | 11/1989 | Japan . |
| 8-44175 | 2/1996 | Japan . |

*Primary Examiner*—Joan Pendegrass
*Attorney, Agent, or Firm*—Robert E. Bushnell, Esq.

[57] ABSTRACT

A process and apparatus for driving an agitator to prevent the cohesion or compacting of developing material due to non-performance of the printing operation for a long period of time. The method and apparatus for driving the agitator in an image forming apparatus uses an electrophotographic developing system by driving the agitator at regular intervals of time so as to prevent developing material within a toner housing from becoming coherent or compacted.

3 Claims, 3 Drawing Sheets

METHOD FOR DRIVING AGITATOR

CLAIM OF PRIORITY

This application makes reference to, incorporates the same herein, and claims all benefits accruing under 35 U.S.C. §119 from an application for METHOD FOR DRIVING AGITATOR earlier filed in the Korean Industrial Property Office on the 24$^{th}$ day of Aug. 1996 and there duly assigned Ser. No. 35458/1996.

BACKGROUND OF THE INVENTION

1. Technical Field

The present invention relates to an image forming apparatus adapting an electrophotographic developing system and, more specifically, to a process and apparatus for driving an agitator to prevent cohesion of developing material.

2. Related Art

In general, electrophotographic developing systems have been widely used in image forming apparatuses such as copying machines, laser beam printers, LED (light emitting diode) printers, and facsimile machines using ordinary paper. As stated herein, conventional electrophotographic developing systems operate by repeating a cycle of charging, exposing, developing, transferring, and fixing operations in a sequential order.

I have noticed that one problem associated with the operation of such systems relates to the fact that, once a developing operation is completed, the developing material sits idle for a period of time and tends to become coherent or compacted. In certain systems, such as that noted in U.S. Pat. No. 5,055,881 to Fukuchi, entitled *Device For Supplying A Toner To A Developing Unit*, once toner is fed from a toner cartridge to a toner supply device, an agitating member is operated for a predetermined period of time to agitate the toner. As an elaboration on that concept, U.S. Pat. No. 5,523,832 to Hamamichi et al., entitled *Electrophotographic Image Fonning Apparatus With Controlled Mixing Of Developer*, discloses an image forming apparatus having a developing device in which the developer standing idle time is measured by a counter once a particular developing operation has ended, and once it is determined that another developing operation is to commence, the determined developer idle time is used to adjust the period of time during which the developer is mixed prior to commencement of the second developing operation. Finally, U.S. Pat. No. 4,977,428 to Sakakura et al., entitled *System For Drive Control Of Toner Agitator In Image Forming Apparatus*, discloses an arrangement wherein low torque is applied to the agitator on "start up", and then higher torque is applied after a predetermined period of time after "start up".

Other efforts in the art relative to developing apparatus and image forming apparatus may be seen in U.S. Pat. No. 5,353,102 to Sato et al., entitled *Two Component Developing Apparatus In A Printer*, U.S. Pat. No. 5,317,370 to Kohyama et al., entitled *Developing Apparatus Including Means For Collecting Used Developing Agent*, U.S. Pat. No. 5,177,546 to Tsubo, entitled *Image Forming Apparatus*, U.S. Pat. No. 5,134,444 to Tabuchi et al., entitled *Image Forming Apparatus*, and U.S. Pat. No. 5,124,752 to Kanno et al, entitled *Developing Apparatus*.

I have found that systems which perform a mixing operation for a predetermined period of time prior to commencement of a developing process (as disclosed in Fukuchi '881), and systems which perform mixing for a period of time determined by the developer standing idle time (as disclosed in Hamamichi et al., '832) do not provide adequate mixing. That is to say, such systems do not agitate the toner or developing material frequently enough so that, when agitation commences, an excessive amount of torque is required. Since such an excessive amount of torque can exceed the system driving torque provide in the engine mechanism, this can cause damage to the motor in a form of gear abrasion, printing impossibility, paper jam, and so forth. Moreover, the reliability of the apparatus is reduced.

If the image forming apparatus is a facsimile machine utilizing general paper or a complex device, a user cannot transmit or receive the fax document for a long time. In addition, often the printing operation cannot be performed for a long time after turning on the laser beam printer. Thus, the electrophotographic developing processor of the image forming apparatus cannot perform an operation for a long time. I have found that with designs found in such contemporary exemplars require more torque than the torque for agitating the toner due to compaction of the toner as a result of non-usage for a long time. That is, since the density of the toner becomes greater, even if the agitator agitates the toner of equal size. Consequently, more force is required to agitate toner which has more weight and is compacted and coherent.

As a result, when driving an agitator to distribute the compacted toner, the torque required exceeds the system driving torque provided in the engine mechanism, thereby causing damage to the motor in the form of gear abrasion, printing impossibility and paper jams, among other malfunctions, thus deleteriously reducing the reliability of the apparatus.

SUMMARY OF THE INVENTION

It is an object of the present invention to provide and improved process and apparatus for driving an agitator of a printer.

It is another object to provide a process and apparatus for driving an agitator to prevent the cohesion or compacting of the developing material generated due to non-performance of the printing operation over an extended period of time.

These and other object may be attained with a process and apparatus for driving an agitator in an image forming apparatus using an electrophotographic developing system, by driving the agitator at regular intervals of time so as to agitate developing material provided within a toner housing of the image forming apparatus.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

Figure 1:
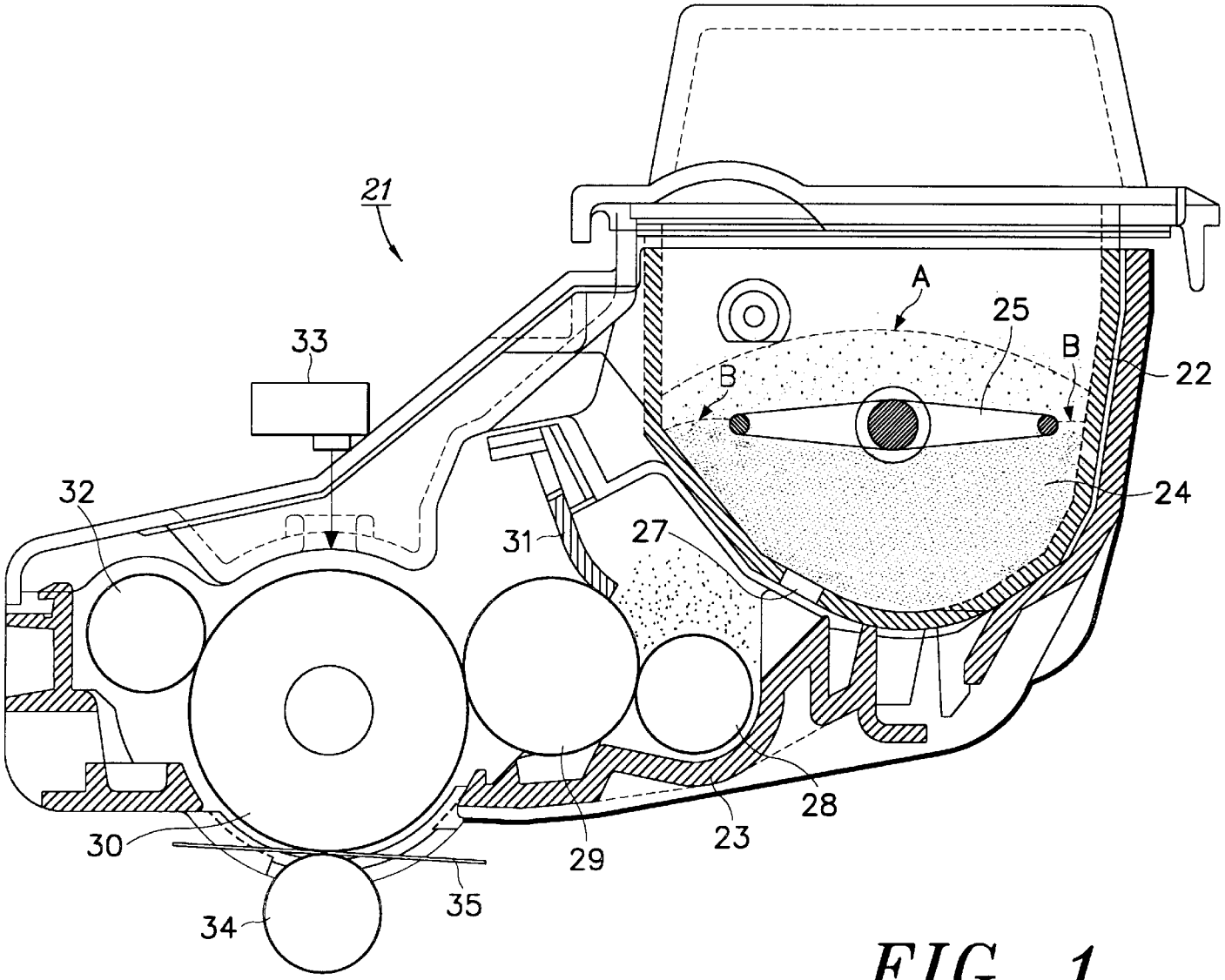
FIG. 1 is a diagram showing the construction of a hypothetical representation of a typical developing device.

Turning now to the drawings, FIG. 1 is a diagram showing the construction of a general developing device, specifically, an engine mechanism performing the developing process and the transferring process mentioned above. A photosensitive drum 30 in FIG. 1 is rotated by means of an engine driving motor as a main motor of the engine mechanism in correspondence with each process of the electrophotographic developing system.

Firstly, in the charging process, the photosensitive drum 30 as a photosensitive medium is charged by a conductive roller 32 as a contact charger so that uniform charges can be formed on the photosensitive drum 30. In this instance, the conductive roller 32 has a negative potential due to a negative charging voltage, and the photosensitive drum 30 is charged by its contact with the conductive roller 32 so as to have a negative surface potential. At this point, the surface potential of the photosensitive drum 30 is, for example, about 500 volts.

In the meantime, in the above state, a conveying roller (not shown) conveys recording sheet 35 fed from a paper feed cassette (not shown), and a register roller arranges upper ends of the recording sheet 35 as it is conveyed along a conveying path by the conveying roller. As the upper ends of the recording sheet 35 are arranged, the recording sheet 35 starts being conveyed to the transfer roller 34 while beginning the exposing process.

Secondly, in the exposing process, the photosensitive drum 30, charged as mentioned previously, is exposed in correspondence with document or image data so that an electrostatic latent image can be formed on the surface of the photosensitive drum 30. Since only a portion of drum 30 corresponding to an image region to be printed is exposed by an exposing device 33, the electrostatic latent image is formed on the surface of the photosensitive drum 30. Then, while the surface potential after charging is maintained in the portion where exposing takes place, the surface potential thereafter is varied in a non-exposed portion, thereby producing an electrostatic latent image having a potential difference between the exposed portion and the non-exposed portion. The exposing device 33 corresponds to a laser scanner unit in a laser beam printer or in a facsimile machine using general paper, or to a document scanner in a copying machine.

Thirdly, in the developing process, toner 24 as the developing material is transferred and attached to the electrostatic latent image created on the surface of the photosensitive drum 30. Previously, the developing process attaches toner 24 to the photosensitive drum 30 where the electrostatic latent image is formed, that is, converts the electrostatic latent image formed on the surface of the photosensitive drum 30 into a visible image using toner 24. At this time, a developing roller 29 has the negative potential by developing bias voltage VD of, for example, approximately −450 volts, and moves to the developing region depending upon the rotation thereof. In this case, the amount of the toner is adjusted by a doctor blade 31, and the toner 24 is evenly dispersed on the surface of the developing roller 29. After that, one part of the toner 24 charged with the negative potential is moved to the developing region and is attached to the exposed region of the photosensitive drum 30 by the potential difference, thereby performing the developing process.

Fourthly, in the transferring process, the toner 24 stuck to the photosensitive drum 30 is transferred to the recording sheet 35 by the transfer roller 34. Then, the toner 24 charged with negative potential attached to the photosensitive drum 30 in the transfer roller 34 is moved in a direction of the recording sheet 35 by the transfer voltage Vt of, for instance, about 800 volts to 1500 volts so as to adhere to the recording sheet 35.

Fifthly, in the fixing process, the toner 24 transferred to the recording sheet 35, as described above, is fixed on the surface of the recording sheet 35 by heat and pressure of a heating roller and a pressure roller, the heating roller and the pressure roller being part of a fixing device (not shown). Following that, once fixation of the toner is completed, recording sheet 25 is ejected to an exterior of the image forming apparatus, so that copying or printing of one page of the recording sheet 35 can be completed.

The operation of supplying the toner 24 to the developing roller 29 in the developing process, as discussed previously, requires that toner 24 provided in a toner housing 22 is agitated by an agitator 25 installed at an interior of the toner housing 22. The agitator 25 is rotated only when the toner 24 is to be fed to a feed roller 28. Also, the toner 24 has a polarity due to rotation of the agitator 25.

In the meantime, the toner 24 in the toner housing 22 escapes through a toner ejector 27 to an exterior of the toner housing 22 due to the rotation of the agitator 25. In this event, the toner 24 escaping via the toner ejector 27 is provided to the developing roller 29 by way of the rotation of the feed roller 28. Most of the toner 24 is preserved in the toner housing 22. If the image forming apparatus is a facsimile machine utilizing general paper or a complex device, a user cannot transmit or receive the fax document for a long time. In addition, often the printing operation cannot be performed for a long time after turning on the laser beam printer. Thus, the electrophotographic developing processor of the image forming apparatus cannot perform an operation for a long time. For this reason, the toner 24 in the toner housing 22 settles and becomes compacted due to magnetic gravity of the toner 24. Accordingly, the volume of the toner 24 is reduced and the density of the toner 24 increases.

The above state is represented in FIG. 1. In FIG. 1, "A" indicates an initial volume of the toner 24 provided within the toner housing 22. The toner 24 having volume "A" due to the agitating of the normal agitator 25 becomes cohered and compacted when not used for a long time. In that case, the volume of the toner 24 is represented as "B". At this moment, the driving torque or the transfer rotation torque of the agitator 25 is provided by the main engine mechanism of the electrophotographic developing processor to agitate the toner 24 so that it returns to volume "A".

However, more torque than the torque for agitating the toner 24 corresponding to "A" is required to agitate the toner 24 which has compacted as a result of non-usage for a long time. That is, since the density of the toner 25 becomes larger, even if the agitator 25 agitates the toner 24 of equal size, more force is required to agitate toner 24 which has more weight and is compacted and coherent. As a result, when driving agitator 25 to agitate the compacted toner 24 as explained above, the torque required to agitate the toner 24 exceeds the system driving torque provided in the engine mechanism, causing damage to the motor. The damage to the motor is in the form of gear abrasion, printing impossibility, paper jam, etc., thereby deteriorating the reliability of the apparatus.

Hereinafter, a preferred embodiment of the present invention is explained with reference to the accompanying drawings. Most of all, throughout the drawings, it is noted that the same reference numerals or letters will be used to designate like or equivalent elements having the same function. Further, in the following description, specific details such as concrete components composing the circuit and the frequency are set forth to provide a more thorough understanding of the present invention. It will be apparent, however, to one skilled in the art that the present invention may be practiced without these specific details. The detailed description of known functions and constructions so as to unnecessarily obscure the subject matter of the present invention will be avoided in the present disclosure.

In the following description, for convenience of explanation, an example of adapting the present invention to the laser beam printer as one of the image forming apparatus using an electrophotographic developing system will be described in detail.

Figure 2:
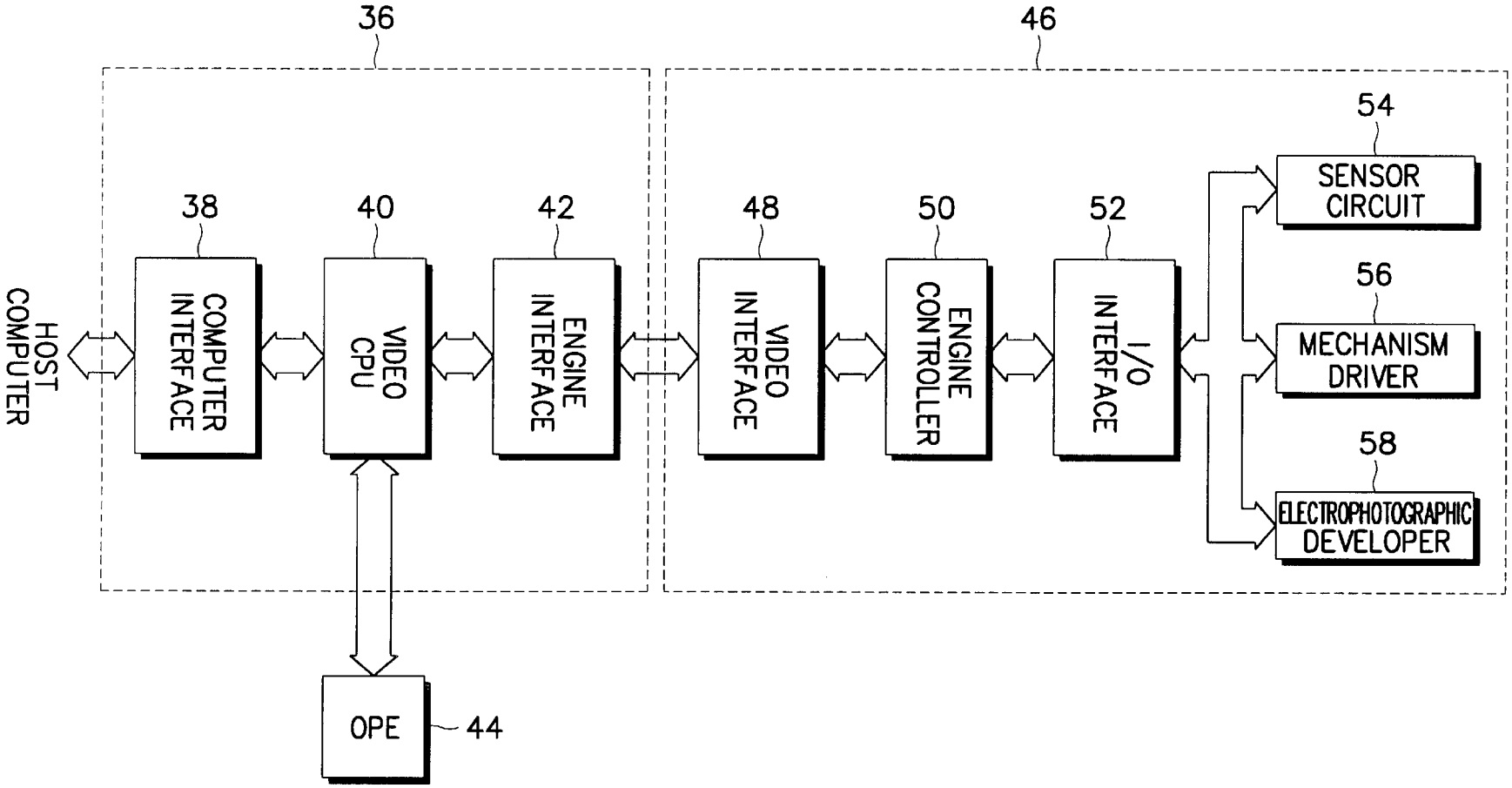
FIG. 2 is a block diagram showing the construction of a printer that may be used in the practice of the present invention.

FIG. 2 is a block diagram showing the construction of a conventional printer. The laser beam printer of FIG. 2 comprises a video controller 36, a print engine 46, and an operational panel equipment 44 (hereinafter, referred to as OPE). The video controller 36 is constructed with a computer interface 38, a video CPU(central processing unit) 40, and an engine interface 42. The computer interface 38 is connected between a host computer and the video CPU 40 and serves as an interface for transmitting/receiving signals therebetween. The video CPU 40 includes a read only memory (hereinafter, referred to as ROM) having a control program, and a random access memory (hereinafter, referred to as RAM) for temporarily storing data. Also, the video CPU 40 converts printing data, received from the host computer through the computer interface 38, into image data to be processed by the print engine 46, and then transmits the converted data to the print engine 46. The engine interface 42 serves as an interface for transmitting input/output signals between the video CPU 40 and the print engine 46.

In the meantime, the OPE 44 is controlled by the video CPU 40, which has a plurality of keys for inputting various commands, and a display for displaying information according to operations of the laser beam printer. Likewise, the print engine 46 including a video interface 48, an engine controller 50, an I/O(input/output) interface 52, a sensor circuit 54, a mechanism driver 56, and an electrophotographic developer 58. The video interface 48 interfaces the input/output signals between the video controller 36 and the engine controller 50. The engine controller 50 controls the mechanism driver 56 and the electrophotographic developer 58 (via I/O interface 52) under the control of the video controller 36, and prints an image on a recording sheet according to the image data received from the video controller 36. Further, the engine controller 50 senses the state of operations of each part of the print engine 46 by means of the sensor circuit 54. The I/O interface 52 is connected between the engine controller 50 and the sensor circuit 54, mechanism driver 56 and electrophotographic developer 58, and serves as an interface for the input/output signals of the engine controller 50. The sensor circuit 54 drives various sensors for sensing the operational states of each part of the print engine 46, the recording sheet feeding and conveying states, and the residual amount of the developing material, and supplies the engine controller 50 with sensing signals of each sensor via I/O interface 52. The mechanism driver 56 drives all kinds of mechanisms for recording sheet feeding, conveying, and printing by controlling the engine controller 50, and the electrophotographic developer 58 prints the image as image data on the recording sheet by using the electrophotographic developing system under the control of the engine controller 50.

Figure 3:
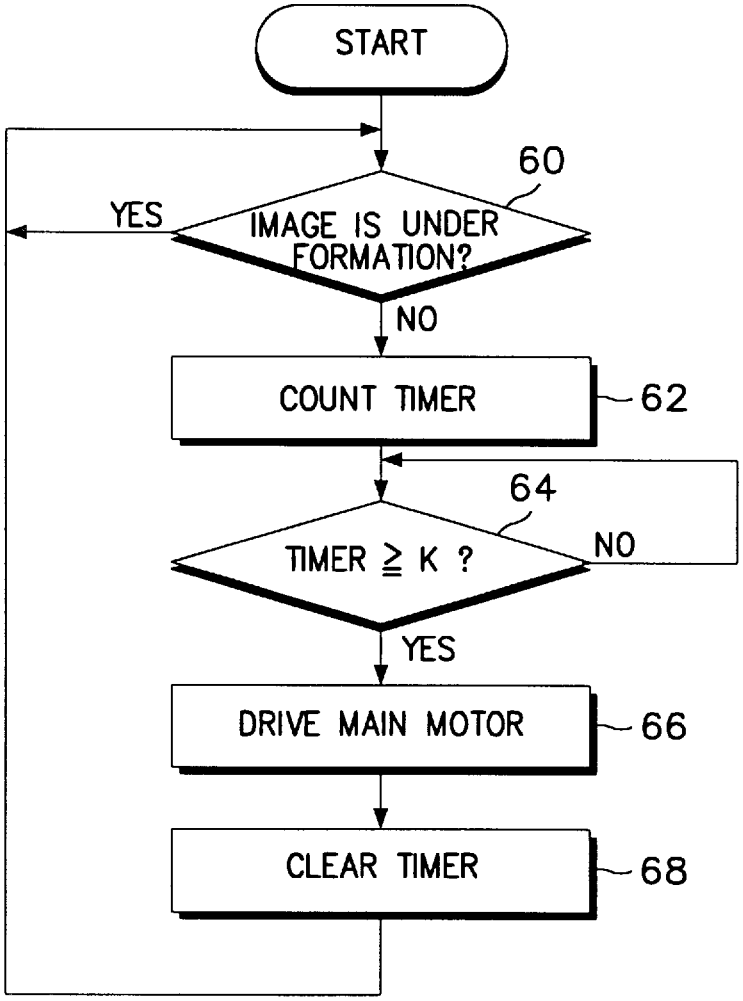
FIG. 3 is a flow chart showing a process for driving an agitator according to the principles of the present invention.

FIG. 3 is a flow chart showing a method for driving an agitator according to a preferred embodiment of the present invention. The engine controller 50 performs operations according to the flow chart of FIG. 3 at specific times. In step 60, the engine controller 50 checks as to whether or not an image is under formation. If an image is under formation, the engine controller 50 returns to and again performs the above step 60. Otherwise, when an image is not under formation, the engine controller 50 proceeds to step 62, thereby causing a timer to count. Once counting is started, the engine controller 50 checks, in step 64, as to whether or not a count value of the timer is more than K, which represents a specific time. The engine controller 50 performs step 66 when the count value is more than K, but performs previous step 64 (i.e., repeats step 64) when the count value is not more than K. In step 66, the engine controller 50 drives the main motor. At this point, when the main motor is driven, the agitator of the toner housing is driven accordingly. Consequently, the toner of the toner housing is agitated.

Once driving of the main motor is completed, the engine controller 50 clears the timer in step 68. Once the timer is cleared, the engine controller 50 returns the aforesaid step 60.

As is apparent from the foregoing, the present invention prevents damage to the motor by preventing the cohesion or compacting of the toner. Moreover, it has a further advantage in that malfunction of the mechanism due to damage to the motor can be further prevented. Therefore, it should be understood that the present invention is not limited to the particular embodiment disclosed herein as the best mode contemplated for carrying out the present invention, but rather that the present invention is not limited to the specific embodiments described in this specification, except as defined in the appended claims.

What is claimed is:

1. A method for driving an agitator in an image forming apparatus using an electrophotographic developing system, comprising the steps of:

(a) determining whether an image is currently being formed in the apparatus;

(b) when an image is not being formed, waiting for a predetermined period of time, and then automatically driving the agitator; and (c) when an image is being formed, returning to and repeating a step of determining whether an image is currently being formed in the apparatus;

wherein said method further comprises the step of providing a main motor to drive the agitator; and wherein said step (b) of automatically driving agitator comprises turning on the main motor to drive the agitator.

2. The method as recited in claim 1, wherein step (b) comprises starting a timer if step (a) indicates that an image is not being formed, checking an output of the timer continuously, and driving the agitator when the output of the timer reaches a value corresponding to the predetermined period of time.

3. A method for driving an agitator in an image forming apparatus using an electrophotographic developing system, comprising the steps of:

(a) continuously checking the electrophotographic developing system to determine whether an image is under formation;

(b) if an image is under formation, returning to step (a) and continuing to continuously check the electrophotographic developing system to determine whether an image is currently being formed in the apparatus;

(c) once it is determined that an image is not being formed, starting a timer so as to count time during which an image is not being formed;

(d) continuously checking the timer to determine when a predetermined time has been counted since an image has not been formed;

(e) once the predetermined time has been counted, automatically driving the agitator to mix developer within the electrophotographic developing system; and (f) once driving of the agitator is completed, clearing the contents of the timer, and returning to step (a);

wherein said method further comprises the step of providing a main motor to drive the agitator, and wherein step (e) comprises turning on the main motor to drive the agitator.

* * * * *